US006379504B1

(12) United States Patent
Miele et al.

(10) Patent No.: US 6,379,504 B1
(45) Date of Patent: Apr. 30, 2002

(54) APPARATUS FOR PULPING SAWDUST

(75) Inventors: Jay J. Miele; Marco Marois; R. Fred Chasse; J. Wayne Chamblee; John D. Weston; J. Robert Prough, all of Queensbury, NY (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 09/981,837

(22) Filed: Oct. 19, 2001

Related U.S. Application Data

(62) Division of application No. 08/520,941, filed on Aug. 31, 1995, now Pat. No. 6,325,888.

(51) Int. Cl.[7] ..... D21C 7/00; D21C 7/06; D21C 7/08; D21C 7/10; D21C 7/14

(52) U.S. Cl. ..... 162/237; 162/71; 162/237; 162/242; 162/243; 162/246; 162/249; 162/250

(58) Field of Search ..... 162/17, 18, 19, 162/56, 60, 68, 52, 91, 71, 99, 237, 242, 243, 246, 249, 250

(56) References Cited

U.S. PATENT DOCUMENTS

| | | | |
|---|---|---|---|
| 3,294,623 | A | 12/1966 | Brinckley et al. |
| 3,475,271 | A | 10/1969 | Laakso |
| 5,266,159 | A | 11/1993 | Greenwood et al. |
| 5,444,884 | A | 8/1995 | Marois |

FOREIGN PATENT DOCUMENTS

| | | |
|---|---|---|
| CA | 1242055 | 9/1998 |

OTHER PUBLICATIONS

Handbook of Pulp & Paper Technologists; Smook, 1982, pp. 85 and 86.

"Sawdust pulping continues to grow; technology improves yield, strength", Bail, Chapter 12, "Pulping Process" by Smith; 1981, pp. 39–43.

TAPPI "Pulp and Paper Maufacture"; vol. 5, Grace 1989, pp. 166–173.

*Primary Examiner*—Steve Alvo
(74) *Attorney, Agent, or Firm*—Nixon & Vanderhye P.C.

(57) ABSTRACT

Chemical cellulose pulp is made from sawdust utilizing a static down-flow retention vessel. By adding steam and cooking liquor to a flow of sawdust a heated slurry, at a cooking temperature of about 250–350° F., is produced. The heated slurry is, at superatmospheric pressure, moved downwardly in the static down-flow retention vessel while cooking temperature is maintained, for a time period of about 0.5–6 (preferably 1 to 3) hours, the slurry having a consistency of about 5–30%. At superatmospheric pressure, without significant reduction in pressure from the retention vessel, the slurry is cooled to well below cooking temperature by diffusing cooling liquid through it, as in a conventional pressure diffuser. The discharge from the retention vessel is preferably substantially solely gravity action (e.g. using a discharge with single convergence and side relief). Various mixing, diluting, thickening, steaming, and pumping devices are utilized in the system from initial steaming of the sawdust to passage into the top of the retention vessel.

10 Claims, 3 Drawing Sheets

APPARATUS FOR PULPING SAWDUST

This application is a division of Application No. Ser. No. 08/520,941, filed Aug. 31, 1995 now U.S. Pat. No. 6,325, 888, the entire content of which is hereby incorporated by reference in this application.

BACKGROUND AND SUMMARY OF THE INVENTION

Many forms of naturally occurring cellulose are used to produce chemical pulps for the production of paper. The form used depends upon the availability of the material and the capability of the pulping equipment. One of the most common forms is the wood chip, either made from hardwoods or softwoods, but any other form of comminuted cellulose material may be used including grasses or agricultural waste, for example, bagasse and cornstalks.

An additional source of cellulose is the waste from saw mills, namely sawdust. Especially in lumber producing regions there is a plentiful supply of sawdust that can be pulped to produce wood pulp. The pulping of sawdust has both advantages and disadvantages. One advantage for using sawdust as a source of cellulose is that the smaller sawdust particles are relatively easy to impregnate with cooking liquor. For this reason the pretreatment systems for chemical pulping of sawdust are less complex than those used to impregnate wood chips, which are generally more difficult to impregnate than sawdust.

One disadvantage of chemical pulping sawdust is that sawdust can be resistant to the flow of cooking liquors. The finely dividing material tends to form a compact matrix when exposed to a liquid flow and limit flow through the material, if not prevent it altogether. For example, since batch digesters are highly dependent upon the capability of providing a cooking liquor circulation through the medium being pulped, it is difficult—if not impossible—to pulp sawdust in a conventional batch digester. Also, conventional continuous digesters, such as Kamyr® continuous digesters, also have difficulty handling sawdust without incorporating some form of special rotating liquid distribution device.

One common method used to continuously pulp sawdust is by using a drag-chain type digesters, for example, an M&D-type digester as shown in FIG. 138 of Volume 5 of TAPPI's *Pulp and Paper Manufacture* (1989), Grace, ed. These type of digesters consist of an inclined vessel through which sawdust is conveyed through the cooking liquor by means of a conveyor mechanism. However, this conveyor mechanism and its related hardware requires continuous maintenance that makes this type of system unsatisfactory in modern pulp mills.

Another mechanical disadvantage of the M&D-type digester for treating sawdust, and the like, is the rotary feed valve used. A typical device is shown in FIG. 139 of Grace. This rotary valve is a typical star-type feeder that inherently experiences an unbalanced pressure load due to the large pressure difference between the inlet and outlet of the valve. This load imbalance typically causes bearing wear requiring repeated maintenance.

In addition to the mechanical disadvantages, these M&D-type systems also have process disadvantages that make these systems less efficient than desired. One characteristic of the M&D-type process is the relatively short retention times. Two aspects of this type of digester limit the retention time: (a) steam heaving and (2) mechanical conveyance. Since the impermeability of sawdust prevents the sawdust from being heated by liquor displacement, the sawdust is heated by direct exposure to steam. The steam or vapor space required to expose the material to steam consumes some of the space that could be used for cooking retention time and hence limits the retention time.

The mechanical conveyor used in an M&D-type digester, referred to as a "drag conveyor", also limits the retention time because of the physical limitations of the size of the conveyor. It is simply too costly to manufacture a larger mechanical conveyor to achieve longer retention times.

As a result, the retention times provided by such a digester are limited to less than 1 hour, typically less than 30 minutes. Typically, additional cooking retention time is obtained when treating sawdust by following the M&D-type digester by ne or more retention vessels, or by "piggy-backing" two or more inclined digesters.

These characteristic short retention times also affect the cooking temperatures that are used. In order to obtain the proper degree of cooking, for example, to achieve a desired H factor, a relatively higher temperature must be used because of the shorter retention time. For example, if a typical cook requiring 2 hours retention time is limited to only ½ hour in an M&D-type digester, the cooking temperature must be increased from approximately 325° F. to 360° F. to achieve a comparable cook. this increase in cooking temperature increases the amount of high-pressure steam needed to maintain the higher cooking temperature. Therefore, the M&D-type digester is not as energy efficient as a digester capable of longer retention times.

These higher temperatures also consume more cooking chemicals and can potentially increase fiber damage. The rate of reaction of cooking chemicals with cellulose is highly dependent upon the prevailing temperature. The higher the temperature the faster and more aggressive the reaction. For kraft systems of the M&D type, the higher cooking temperatures, required for the shorter cooking times, result in higher reaction rates. This typically can cause increased chemical consumption and increased cellulose degradation.

The disadvantages of the M&D-type digester for cooking sawdust, and the like, are also seen in the "Pandia"-type digester shown in FIGS. 141 and 143 of Grace.

Another conventional continuous sawdust pulping system, shown in Grace, FIG. 133, and Smook, Handbook for Pulp and Paper Technologists, 1982, page 86 (FIGS. 8–17), comprises a cylindrical vessel fed by two horizontal screw conveyors and a pocket feeder, for example, a Kamyr® asthma feeder. This type of vessel is a steam-phase type in which a liquid level is maintained below the top of the vessel and steam is added to the space above the liquid level. The sawdust fed to this vessel by the pocket feeder is heated to cooking temperature by the added steam. This steam heating avoids the impractical practice of circulating heated liquor to heat to cooking temperature.

As described by Grace, the pulp in this type of digester is cooled by introducing wash filtrate to the bottom of the digester and extracting it by means of a centrally-located rotating cylindrical screen. (See U.S. Pat. No. 3,475,271 of Laakso.) However, due to the impermeability of finely divided material like sawdust, this method of extraction has been shown to be unstable.

This "asthma-feeder" style sawdust cooking system also has the disadvantage that the feed system is located above the digester vessel. This is because the asthma feeder is limited to transporting the sawdust a short distance. This limits the size and flexibility of such installations.

Another sawdust pulping system is shown in Canadian patent 1,242,055. This patent discloses the use of a conventional slurry pump to feed a slurry of sawdust and cooking liquor to a cylindrical digester. This transfer of medium consistency slurry by means of a pump prior to cooking is not energy efficient. Typically, such pumps are limited to medium consistency slurries of between 8 and 16% consistency. In heating such a slurry to cooking temperature the excess liquid volume must also be heated to cooking temperature. For example, a 12% slurry contains 7.33 lbs. of liquid per lb. of fiber. In contrast, a 30% slurry contains 2.33 lbs. of liquid per lb. of fiber, or less than a third of the liquid per lb. of fiber. The lower consistency slurry requires additional energy to heat this excess liquid to cooking temperature.

Furthermore, no effort is made to minimize the mechanical action on the pulp or to recover heat from the cooked pulp slurry. Excessive mechanical action on sawdust slurries can be damaging to fiber properties, and is otherwise undesirable.

The present invention avoids these limitations of prior art continuous cooking systems for sawdust, and other finely divided comminuted fibrous material by first eliminating the need for high pressure mechanical feeders and conveyors; second, by discharging hot, pressurized cooked sawdust without cooling and without the aid of a rotating discharge device; and third by recovering the heat of the cooking reaction in an efficient economical manner.

The invention addresses the problems inherent in treating sawdust, or other finely divided source of cellulose material (which is within the scope of the term "sawdust" as used in the present specification and claims, e.g. initial cellulose particles which flow more like a powder than they flow like conventional wood chips), and provides for more efficient pulping, requiring less maintenance. The invention is practiced utilizing a static retention vessel. A "static" vessel is one without any significant internal circulation, which internal circulation typically includes (in conventional continuous digesters for example) screens, conduits, pumps, heaters, and the like. While steam or heated liquid may be added to the pulp in the retention vessel, to ensure that it is retained at cooking temperature (although that is not normally necessary), there is no attempt to draw liquid uniformly through the vessel as in conventional batch and continuous digesters.

According to one aspect of the present invention a method of producing cellulose pulp from sawdust utilizing a static down-flow retention vessel is provided. The method comprises the steps of continuously: (a) Adding steam and cooking liquor to a flow of sawdust to produce a heated slurry of sawdust and cooking liquor at a consistency of between about 10–35%, preferably 20–30%, and a cooking temperature of between about 250–350° F. (b) Passing the heated slurry from step (a) at superatmospheric pressure downwardly in the static down-flow retention vessel, and retaining the slurry in the retention vessel at cooking temperature between about 0.5–6 hours, and then discharging it at a consistency of between about 5–20% from the retention vessel. And, (c) at superatmospheric pressure, without significant (i.e. destructive to the fiber) reduction in pressure from the retention vessel, cooling the slurry discharged from the retention vessel by diffusing cooling liquid therethrough so that the temperature of the slurry drops below cooking temperature, and cooking thereof is terminated.

Step (b) is preferably practiced to discharge the slurry from the retention vessel without mechanically acting on the slurry (that is no mechanical agitator, pump, or like structure being provided). In fact it is desirable to discharge the slurry from the retention vessel substantially by gravity action alone (as by using a discharge having single convergence and side relief).

Step (a) may be practiced by initially forming a slurry at a first consistency greater than about 20%, and then successively: diluting and heating the slurry so that it has a readily pumpable second consistency of less than 20%; rethickening the slurry to a consistency of greater than about 20%; and then diluting and heating the slurry. Steps (a) through (c) are typically practiced to produce a chemical cellulose pulp having a Kappa No. of between about 10–30 (e.g. less than 24) with a yield of about 38–45% (e.g. about 39–42%).

There may also be the further step of pre-steaming the sawdust prior to step (a) in a steaming vessel and discharging the presteamed sawdust from the steaming vessel substantially by gravity action alone. There are also typically the further steps of washing and bleaching the pulp from step (c) depending upon the final product to be produced. Step (c) is also typically practiced by upflowing the suspension through a pressure diffuser at a consistency of about 5–20%. Step (a) is typically practiced to heat the slurry to a cooking temperature of between about 300–330° F., and step (b) is practiced by maintaining the cooking temperature in the retention vessel about 1–3 hours.

Step (a) may be practiced by: diluting the slurry so that it has a diluted consistency of about 20% (e.g. about 10%) or less, and pumping the diluted consistency slurry to an elevated level near the top of or above the retention vessel; thickening the slurry at the elevated level to a consistency of about 20–40%; and steaming the thickened elevated slurry to increase the temperature thereof while diluting it to a consistency of about 5–20%.

According to another aspect of the present invention a system for (continuously) producing chemical pulp from sawdust is provided. The system preferably comprises the following components: A static down-flow superatmospheric pressure retention vessel having a top for receipt of a sawdust slurry, and a bottom for discharge of chemical pulp. A first mixer for mixing steam and cooking liquor with sawdust to form an initial slurry. Subsequent means for diluting, raising the temperature to cooking temperature, and pressurizing the initial slurry to provide a slurry suitable for cooking, and elevating the slurry to the top of the retention vessel to feed slurry into the top of the retention vessel. A non-mechanical discharge from the bottom of the retention vessel. And, a superatmospheric pressure vessel connected to the non-mechanical discharge for diffusing cooling liquid into pulp after the pulp is discharged from the bottom of the retention vessel to lower the temperature thereof below cooking temperature.

The subsequent means may comprise a thickener substantially at or above the top of the retention vessel, and connected to a steam mixer, the steam mixer connected to the top of the retention vessel and above it. The first mixer may comprise a screw conveyor mixer. The non-mechanical discharge may comprise a discharge with single-convergence and side relief. The subsequent means may comprise: a discharge chute having a top portion connected to the screw conveyor mixer, and a bottom portion; dilution liquid addition means to the discharge chute; a pump adjacent the discharge chute bottom portion and a conduit extending from the pump to the thickener; and/or dilution liquid addition means connected to the conduit from the pump. The superatmospheric pressure vessel preferably comprises a pressure diffuser.

The system may further comprise a second conduit from the thickener connected to the dilution liquid addition means to the conduit from the pump, and a heat exchanger for heating liquid in the second conduit disposed between the thickener and the dilution liquid addition means. A flash tank may be connected to the second conduit and includes a flash steam outlet and a liquid outlet, the flash steam outlet connected to the dilution liquid addition means to the discharge chute, and the flash steam outlet connected to the first mixer. Though the invention is disclosed for use with sawdust, one skilled in the art would recognize that for various aspects of the invention any other form of comminuted fibrous material may be used, for example, wood chips, agricultural waste or grass.

It is the primary object of the present invention to simply and effectively produce a relatively low Kappa No. chemical pulp, with relatively high yield, from sawdust. This and other objects of the invention will become clear from an inspection of the detailed description of the invention, and from the appended claims.

DETAILED DESCRIPTION OF THE DRAWINGS

Figure 1:
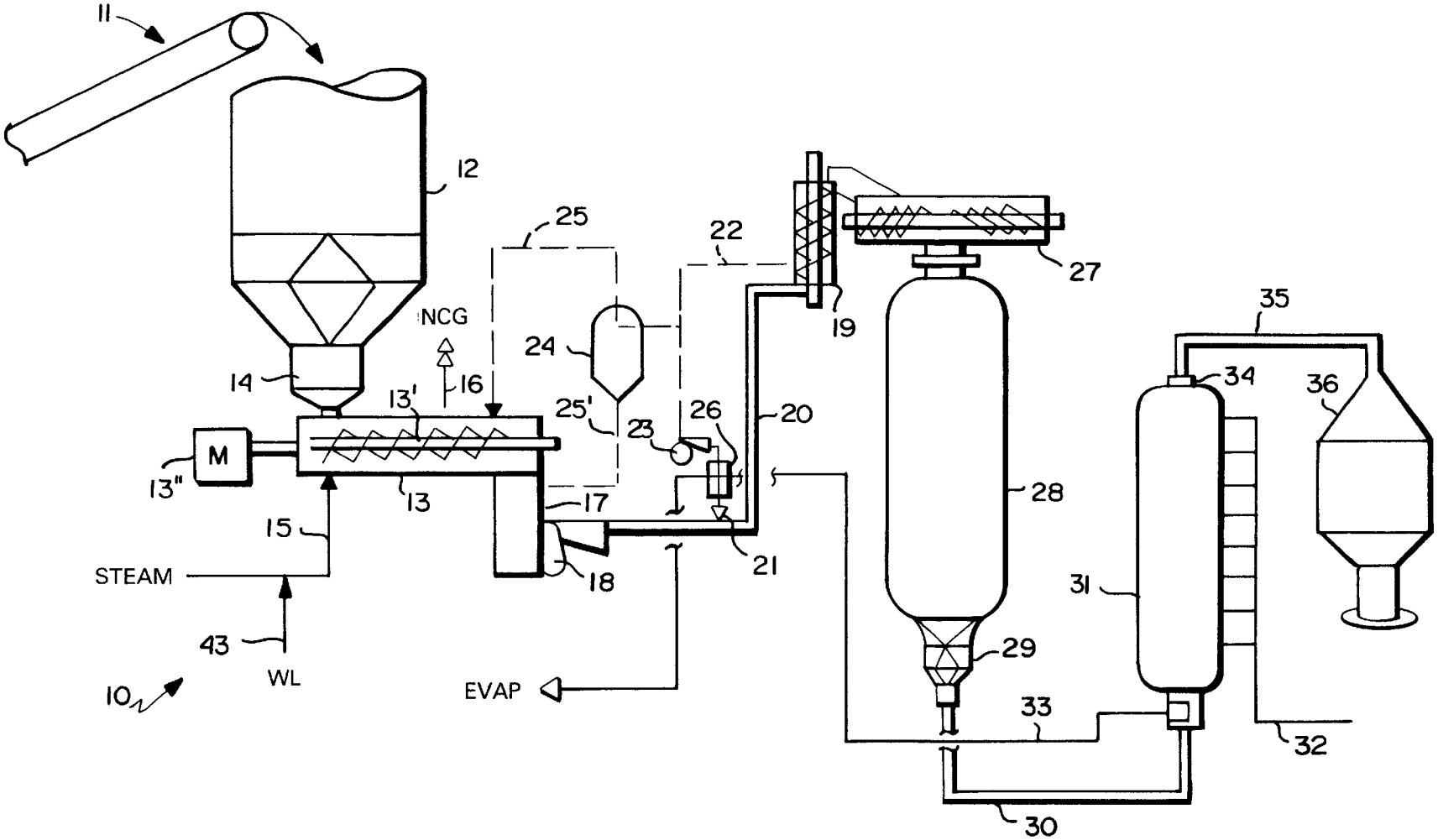
FIG. 1 is a schematic side view of a typical embodiment of a system according to the present invention.

FIG. 1 shows a schematic diagram of a typical system 10 for pulping finely divided comminuted cellulose material referred to as "sawdust" herein. The sawdust is fed continuously by conveyor 11 into a pretreatment vessel 12. Pretreatment my consist of steaming or treatment with black liquor or some other strength or yield enhancing chemical, for example polysulfide or anthraquinone and their derivatives. Treatment and retention in vessel 12 may be from 5 to 60 minutes, but is preferably between 5 and 20 minutes. The vessel 12 may operate at atmospheric or super-atmospheric pressures.

The treatment vessel, 12, may exhibit single-convergence and side relief as disclosed in pending U.S. patent application Ser. No. 08/189,546 filed on Feb. 1, 1994, now U.S. Pat. No. 5,500,083 and Ser. No. 08/366,581 filed on Dec. 30, 1994, now U.S. Pat. No. 5,628,873. Such a retention vessel is sold under the trademark "Diamondback" by Ahlstrom Kamyr Inc. of Glens Falls, N.Y.

The vessel 12 discharges into a conveyor 13 which includes a conventional conveying screw as shown in FIG. 1, or any other conventional means of conveying the pretreated sawdust may be provided. The conveyor 13 typically comprises a screw 13" driven by a drive device such as an electric motor 13"", for example a variable speed electric motor. If the conveyor 13 is pressurized, some form of pressure-isolation device can be used between the vessel 12 and the conveyor 13. For example, a star-type feeder, such as an Ahlstrom Kamyr low pressure feeder 14 may be used. The conveyor 13 is a first mixer for mixing steam and cooking liquor with the sawdust.

Cooking liquor, for example kraft white liquor, is added to the conveyor 13 in line 43 to begin the impregnation of the material with cooking chemicals. Steam is also preferably added to the conveyor 13 via line 15, to begin the heating, or continue the heating begun in the vessel 12, of the material and to remove unwanted air form the material. The conveyor 13 may also include a vent 16 for releasing non-condensable gases (NCG) to a conventional NCG collection system. A slurry having a consistency of about 25% or more and a temperature of between about 125° F.–175° F. is discharged from conveyor 13.

The conveyor 13 discharges to a feed chute 17 in which the sawdust slurry is diluted to a consistency of between about 5 to 20%, preferably about 10 to 15%. The temperature of the slurry in the chute 17 may be between about 150 to 250° F., typically about 160 to 200° F. The chute 17 feeds a conventional slurry pump 18. The pump 18 pressurizes and transfers the heated material and cooking liquor slurry to a conventional dewatering conveyor 19 via conduit 20. The slurry may be diluted to lower the consistency thereof by at least 2%, and preferably between about 5–10%, in the conduit 20, e.g. by dilution liquid (e.g. recirculated liquor, filtrate or hot water), added via conduit 21, to a consistency of between about 3 and 15%, typically about 5 to 10%. The dewatering conveyor 19 may be a conventional separator such as a "top separator" or an "inverted top separator" as sold by Ahlstrom Kamyr. This conveyor 19 may alternatively be a "Stocker" as sold by A. Ahlstrom Corp. of Helsinki, Finland.

The liquor removed from this dewatering conveyor 19, via line 22, which is typically at about 250 to 300° F., may be used as the source of dilution in the conduit at 21, after being pressurized in pump 23 and heated in heat exchanger 26, and/or all or part of it may be flashed to produce a source of steam using conventional flash tank 24. For example, the pressure of the hot liquor 22 may be decreased under controlled conditions, i.e., flashed, in flash tank 24 to produce a source of contaminated steam in line 25. The steam in line 25 may be used as the source of steam introduced to the conveyor 13 or vessel 12. This contaminated steam may be supplemented by clean steam as needed. The hot flashed liquor from tank 24, in line 25", may be used as the source of dilution liquid in chute 17, or elsewhere.

The dewatering conveyor 19 increases the consistency of the slurry to between about 20–40% and discharges the slurry to a conventional steam mixer 27. The steam mixer 27 may be any conventional device (e.g. having an internal conveying screw) for introducing steam to the slurry and heating the slurry to cooking temperature, typically about 250 to 350° F., preferably about 300 to 330° F., while its consistency is being diluted by the steam addition to between about 15–35%, preferably 10–20%. The structures 17, 18, 20, 19, 27, 22, 24, etc. between first mixer 13 and the discharge from steam mixer 27 are one exemplary embodiment of subsequent means for diluting, raising the temperature to cooking temperature, and pressurizing the slurry from conveyor mixer 13 before cooking. A wide variety of other conventional pressurizing, temperature raising, and dilution and thickening devices may be provided.

The steam-heated slurry is discharged from the mixer 27 to a retention vessel/digester 28 in which the cooking reaction is allowed to proceed. The retention time in vessel 28 may range from about 30 minutes to about 6 hours but is typically about 1 to 3 hours, preferably 1 to 1½ hours. Note that vessel 28 is static, that is it does not include any real cooking circulations, and associated screens, because cooking circulations would be difficult to operate for such a finely comminuted material as sawdust. The vessel 28 need not include an agitator at its discharge 29 but preferably includes as the discharge 29 a non-mechanical means, such as a single-convergence outlet with side relief as illustrated schematically in FIG. 1, and as discussed previously for vessel 12, and/or liquid discharge jets or nozzles.

The material discharged through discharge 29 from vessel 28, typically at between about 5 and 20% consistency, is transferred, while still at cooking temperatures and pressures (and without destructive reduction of pressure), via conduit 30 to a second treatment vessel 31. In treatment vessel 31 the cooked, hot, pressurized material is cooled by means of filtrate from line 32. The heat of the treated material entering vessel 31 is removed via liquid extraction line 33 and used, for example, as a source of heat for heat exchanger 26. The hot liquor in line 33 is cooled somewhat in heat exchanger 26 and may then be sent to a conventional chemical recovery system, for example, to one or more flash tanks, to evaporators, a recovery boiler, etc. The liquor in line 33 may also be used to treat material in vessels 12, 13 or 17.

The vessel 31 is preferably an MC® Pressure Diffuser as sold by Ahlstrom Kamyr. The cooked material is typically cooled by diffusing the cooler liquid from line 32, typically brownstock washer filtrate, through the pulp bed. The pulp is cooled to below cooking temperature (e.g. below about 250° F.) in vessel 31. The hot cooking liquor is displaced by the cooler liquid in this process and the hot displaced liquor is extracted as is conventional from the bottom of the pressure diffuser (in line 33). The cooled material is discharged from the top 34 of the vessel 31 and passed by conduit 35 to a high density brown stock storage vessel 36 or the like. The material stored in vessel 36 may be further treated by, for example, washing or bleaching, and sent to a paper, board or pulp machine.

Figure 2:
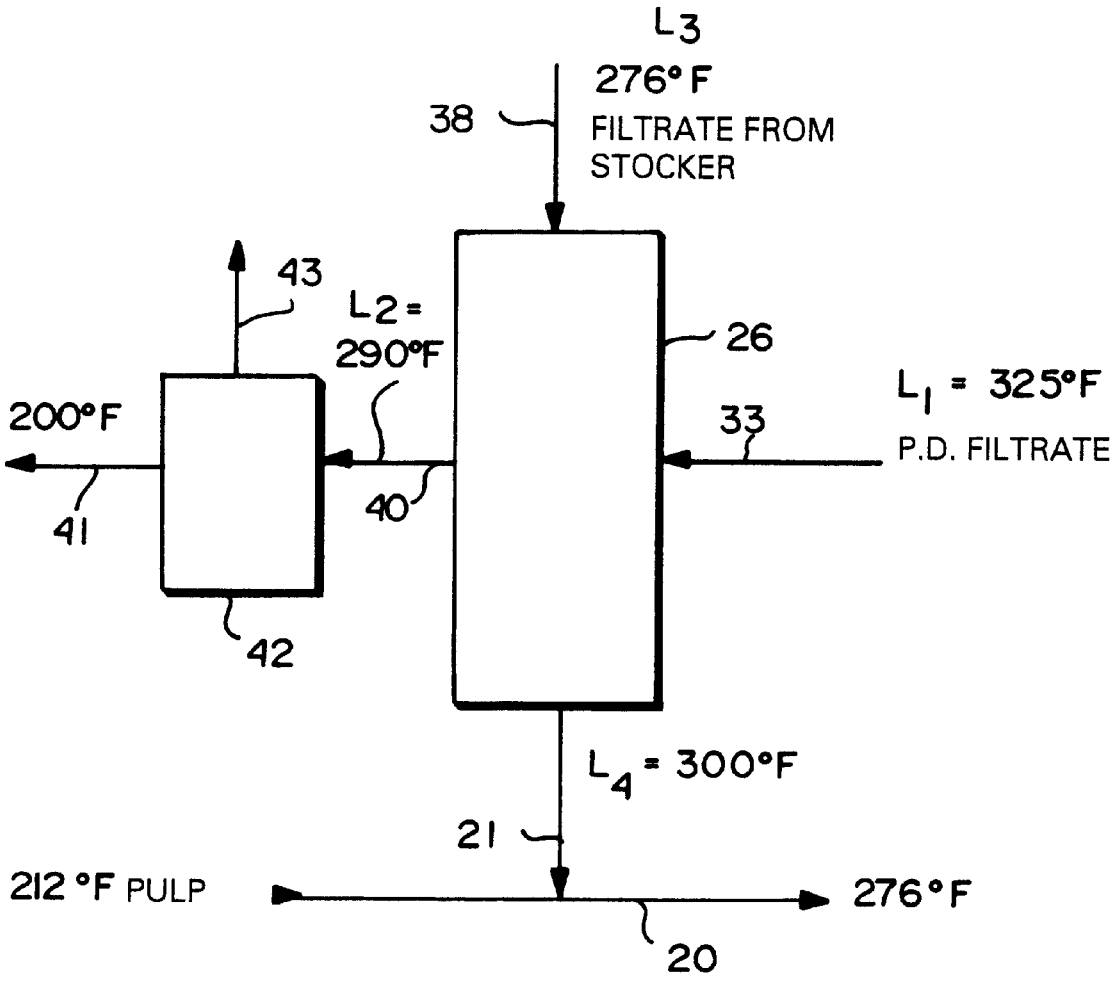
FIG. 2 is a side schematic view of a typical heat exchanger used with the system of FIG. 1.

FIG. 2 illustrates the typical temperatures around the conventional, non-contact heat exchanger 26. Hot extract in line 33 from the cooling vessel [e.g. a pressure diffuser] 31 is typically between about 250–350° F., preferably between about 300–325° F., and is cooled at least about 25° F. in heat exchanger 26 to between about 200–300° F., preferably about 275 to 300° F. The liquor from the dewatering conveyor 22 and pump 23 [i.e. 38 in FIG. 2] is normally between about 200–300° F., typically about 260 to 280° F. The liquid in line 38 is heated at least about 25° F. to about 270 to 325° F., typically about 290 to 310° F., in heat exchanger 26 before entering conduits 21 then 20. The material slurry in conduit 20 is typically heated by the addition of liquid from line 21 from between about 150–250° F., typically between about 160–200° F., by at least about 50° F., e.g. to between about 200 to 300° F., typically to between about 270 to 290° F.

The now cooler, but still hot (e.g. about 290° F.) liquid from line 33 is discharged from heat exchanger 26 into line 40. It may then be used for heat recovery elsewhere before being passed to recovery in line 41, e.g. by preheating white liquor in heat exchanger 42, pre-heated white liquor (e.g. for addition to line 15) being discharged in line 43 from preheater 42.

Using the process and apparatus described, for example, a primarily or completely softwood sawdust can be pulped to a Kappa number between about 10–30, typically about 20–24 (e.g. about 22). The pulp yield will typically range from 38 to 45%, typically about 39–42% (e.g. about 40%).

Figure 3:
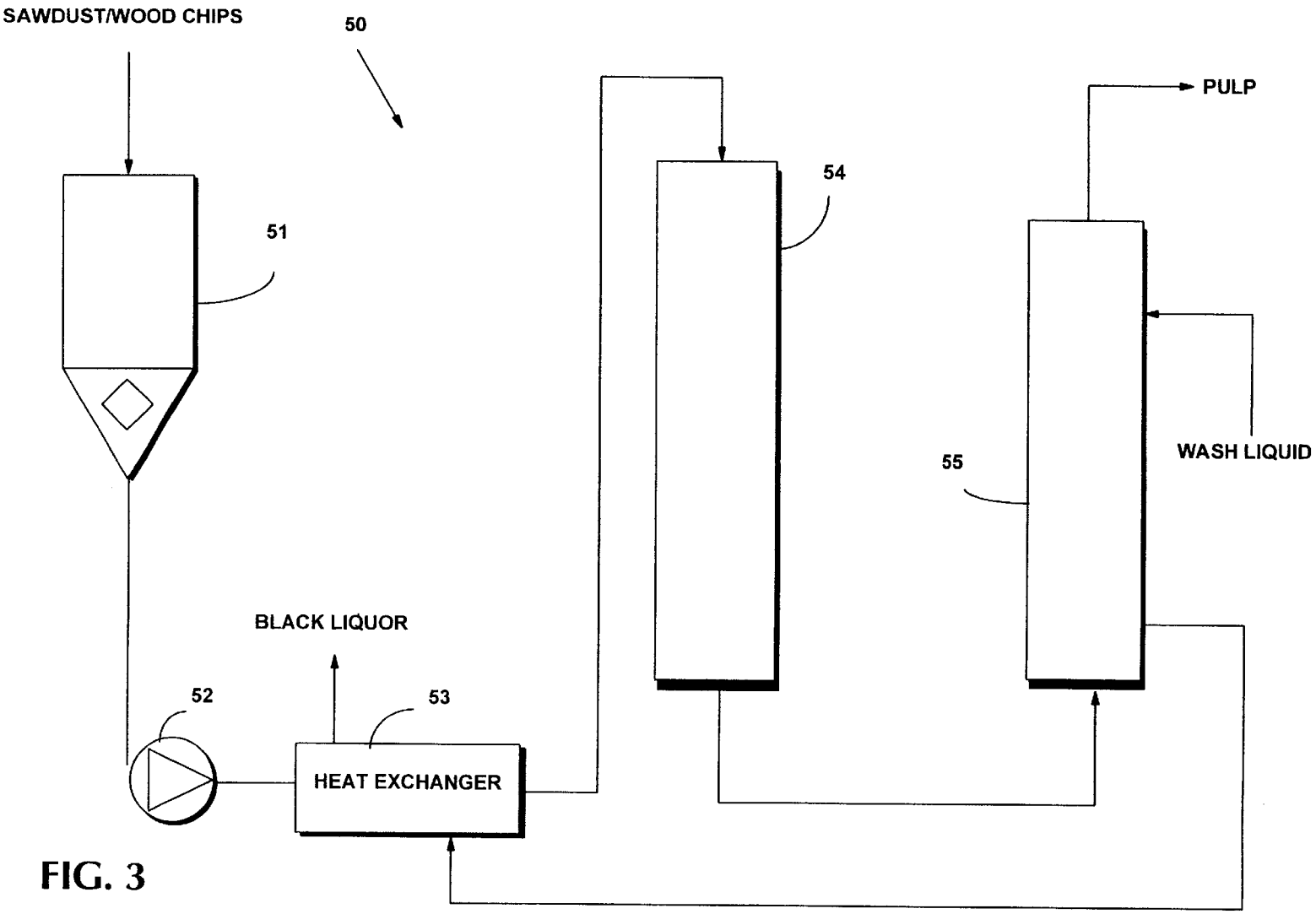
FIG. 3 is a side schematic view of a further typical embodiment of a system according to the invention.

FIG. 3 illustrates an additional embodiment of a system for pulping sawdust, or similar finely divided comminuted cellulose material. The system 50 includes pretreatment vessel 51, typically including an outlet having single convergence and side relief (e.g. a "Diamondback"™ chip bin), a slurry pump 52; a heat exchanger 53; a continuous digester 54; and a pressurized washer, typically a pressure diffuser 55.

The distinct feature of the FIG. 3 embodiment compared to the FIG. 1 embodiment is the heat exchanger 53. Instead of using the heat recovered from the washer 55 to indirectly heat dilution liquor which is used to heat the slurry before cooking, the hot liquor extracted from the washer 55 is used directly in an indirect heat exchanger 53 to heat the cellulose slurry prior to cooking in digester 54. By doing so, the need for the dewatering conveyor 19 and steam mixer 27 of FIG. 1 is eliminated.

The heat exchanger 53 may be of the lamellar type with alternating vertical or horizontal lamellar heating elements through which the slurry passes, or of a wide variety of conventional designs used in the pulp and paper art.

In one typical application of the system shown in FIG. 3, cellulose material, e.g. sawdust or wood chips, water and cooking liquor, typically kraft white liquor, are added to the pretreatment vessel 51. Since the incoming cellulose material is typically composed of about 50% cellulose and 50% water, the cellulose is added at a rate of 2 tons of cellulose, or wood fiber, per ton of pulp produced (t/tp); and water is introduced at a rate of 2 t/tp. Additional liquid is typically added as steam or cooking liquor at a rate of 4 t/tp; this liquid typically contains approximately 0.6 t/tp dissolved solid material.

After combining the cellulose and liquid in vessel 51 to create a slurry of material it is pumped by slurry pump 52 at a consistency of between about 20 and 30%, typically about 27%. This slurry now typically contains 5.4 t/tp liquid, 2.0 t/tp cellulose, and 0.6 t/tp dissolved solids. In passing through heat exchanger 53, the slurry temperature is typically raised from approximately 200° F. to a cooking temperature of about 325° F. before passing to the digester 54. The slurry temperature may have to be augmented by an additional heating device, for example, a steam mixer as in FIG. 1, to obtain cooking temperature should the temperature increase in the heat exchanger 53 not be sufficient.

The cooked material is discharged from the digester 54, again typically without the aid of any mechanical discharge device, at a consistency of between about 10 and 20%, typically about 15.6%. Due to the pulping process, again assuming a 50% yield, the pulp slurry contains approximately 5.4 t/tp liquid, 1.0 t/tp cellulose fiber, and 1.6 t/5p dissolved solids.

The hot, solids-containing pump is then passed, while still at digester temperature, e.g., 300–350° F., and digester pressure, e.g., 140–180 psi, to a pressurized washer 55. The washer, which is typically an MC® Pressure Diffuser as sold by Ahlstrom Kamyr of Glens Falls, N.Y., is used to diffusion wash, dilute, and displace the hot cooking liquor. The wash water is typically applied at a rate of 9.4 t/p (e.g., for a typical dilution factor of 2.0) to produce a cleaner, cooler pulp at between about 8 and 16% consistency, typically about 12%. The fiber slurry now contains approximately 1 t/p (by definition) and 7.4 t/tp liquid.

The hot extraction liquor removed from the washer 55, that is, the black liquor at between about 300 and 350° F., typically 325° F., is used as the heat source in heat exchanger 53. This black liquor typically contains approximately 7.4 t/tp liquid and 1.6 t/tp dissolved solid material, corresponding to a black liquor solids concentration of between about 15 and 20% dry solids.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for producing chemical pulp from sawdust, comprising:

a static down-flow superatmospheric pressure retention vessel having a top for receipt of a sawdust slurry, and a bottom which includes non-mechanical discharge means for discharging chemical pulp;

a first mixer means for mixing steam and cooking liquor with sawdust to form an initial slurry, subsequent means for diluting, raising the temperature to cooking temperature, and pressurizing the initial slurry to provide a slurry suitable for cooking, and elevating the slurry to the top of said retention vessel to feed slurry Into the top of the retention vessel; and a superatmospheric pressure vessel connected to said non-mechanical discharge means and including means for displacing cooking liquid from the pulp after the pulp is discharged from the bottom of said retention vessel to lower the temperature thereof below cooking temperature.

2. A system as recited in claim 1 wherein said subsequent means comprises a thickener substantially at or above the top of said retention vessel, and connected to a steam mixer, said steam mixer connected to said top of said retention vessel and above said retention vessel.

3. A system as recited in claim 1 or 2 wherein said non-mechanical discharge means comprises a discharge with single-convergence and side relief.

4. A system as recited in claim 3 wherein said first mixer means comprises a screw conveyor mixer.

5. A system as recited in claim 4 wherein said subsequent means comprises: a discharge chute having a top portion connected to said screw conveyor mixer, and a bottom portion; dilution liquid addition means to said discharge chute; a pump adjacent said discharge chute bottom portion and a conduit extending from said pump to said thickener; and dilution liquid addition means connected to said conduit from said pump.

6. A system as recited in claim 1 wherein said superatmospheric pressure vessel comprises a pressure diffuser.

7. A system as recited in claim 1 wherein said subsequent means comprises: a discharge chute having a top portion connected to said first mixer, and a bottom portion; dilution liquid addition means to said discharge chute; a pump adjacent said discharge chute bottom portion and a conduit extending from said pump; dilution liquid addition means to said conduit from said pump; a thickener substantially at or above the top of said retention vessel and connected to said conduit from said pump; and a steam mixer connected to said thickener and the top of said retention vessel.

8. A system as recited in claim 7 further comprising a second conduit from said thickener connected to said dilution liquid addition means to said conduit from said pump, and a heat exchanger for heating liquid in said second conduit disposed between said thickener and said dilution liquid addition means.

9. A system as recited in claim 8 further comprising a flash tank connected to said second conduit and including a flash steam outlet and a liquid outlet, said flash steam outlet connected to said dilution liquid addition means to said discharge chute, and said flash steam outlet connected to said first mixer.

10. A system as recited in claim 1, wherein said non-mechanical discharge means comprises liquid discharge jets or nozzles.

* * * * *